US005384971A

United States Patent [19]

Ferry

[11] Patent Number: 5,384,971

[45] Date of Patent: Jan. 31, 1995

[54] BOOTS FOR OUTDOOR USE BY SPORTS PERSONS

[76] Inventor: James E. Ferry, 51 Amsden St., Malone, N.Y. 12953

[21] Appl. No.: 164,760

[22] Filed: Dec. 10, 1993

[51] Int. Cl.[6] ..... A43B 11/00

[52] U.S. Cl. ..... 36/105; 36/50.1; 36/4

[58] Field of Search ..... 36/84, 50.1, 4, 59 C, 36/50.5, 99, 105

[56] References Cited

U.S. PATENT DOCUMENTS

| | | | |
|---|---|---|---|
| 436,553 | 9/1890 | Wilson | 36/59 C |
| 470,316 | 3/1892 | Brown | 36/50.1 X |
| 1,172,770 | 2/1916 | Deutsch | 36/50.1 |
| 1,185,119 | 5/1916 | Marshall | 36/4 |
| 1,294,179 | 2/1919 | Schneider | 36/50.1 |
| 1,331,713 | 2/1920 | Krieg | 36/59 C |
| 1,334,009 | 3/1920 | Archambeau | 36/4 |
| 1,601,278 | 9/1926 | Williams | 36/50.1 |
| 2,071,593 | 2/1937 | Thormann | 36/50.5 |
| 2,178,885 | 11/1939 | Buff et al. | 36/50.1 X |
| 2,236,278 | 3/1941 | Tousley | 36/59 C |
| 2,306,306 | 12/1942 | Ferrettie | 36/4 |
| 2,330,224 | 9/1943 | L'Holler | 36/50.1 |
| 2,420,239 | 5/1947 | Hack | 36/50.1 X |
| 2,619,744 | 12/1952 | Mattes | 36/105 |
| 3,192,651 | 7/1965 | Smith | 36/105 |
| 3,228,122 | 1/1966 | Ludwig | 36/99 X |
| 3,545,107 | 12/1970 | Cinquegrana et al. | 36/50.1 |
| 3,721,024 | 3/1973 | Innerbickler | 36/4 |
| 4,592,154 | 6/1986 | Oatman | 36/50.1 X |
| 4,845,862 | 7/1989 | Phillips, Jr. et al. | 36/4 X |
| 5,168,643 | 12/1992 | Laurain | 36/25 R |

FOREIGN PATENT DOCUMENTS

| | | | |
|---|---|---|---|
| 0208740 | 5/1940 | France | 36/50.1 |
| 1126589 | 11/1956 | France | 36/50.1 |

*Primary Examiner*—Paul T. Sewell
*Assistant Examiner*—Ted Kavanaugh

[57] ABSTRACT

New and improved boots for outdoor use by sports persons and the like comprising, in combination, an upper formed of an instep section, a back ankle section, a lower forward peripheral section and with an opening along the upper front with a tongue within the opening, a plurality of eyelets formed along the upper front opening with lacings extending through the eyelets above the tongue for enclosing the opening during use, a plurality of metallic rings extending in vertical lines adjacent the back ankle section from below the ankle to above the ankle with lacings extending through the rings for providing additional support to the rear a wearer's boot and lower leg; and a sole having an intermediate layer as an extension of the upper with a layer of flexible material thereabove and a sponge rubber sole therebelow in the forward portion and a rubber heel therebelow in the rear portion, the rubber heel being formed with a peripheral ridge and linear projections extending forwardly and rearwardly thereof along the length of the heel.

1 Claim, 3 Drawing Sheets

FIG. 3
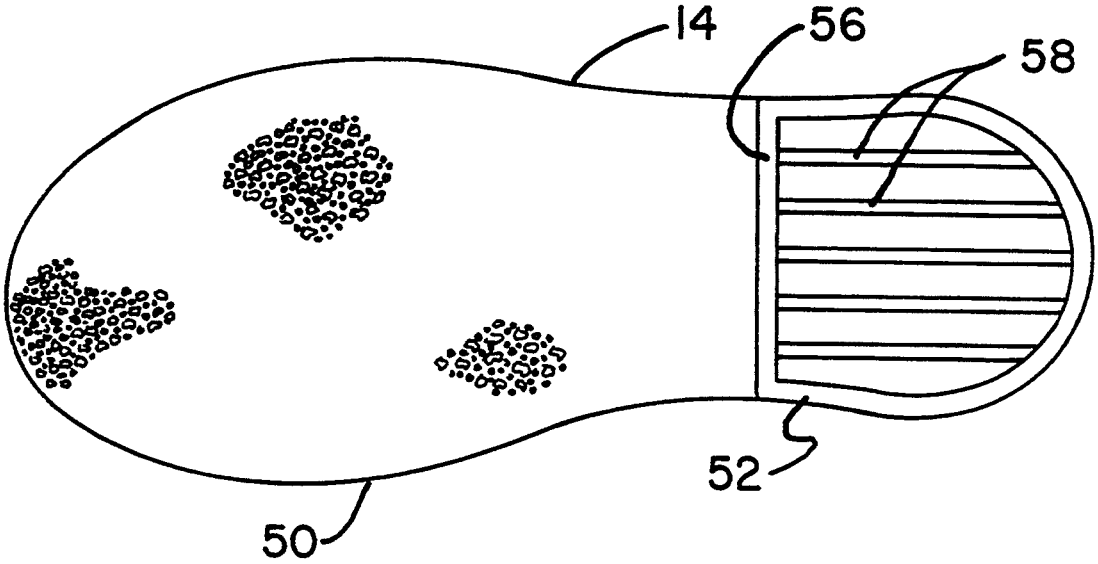
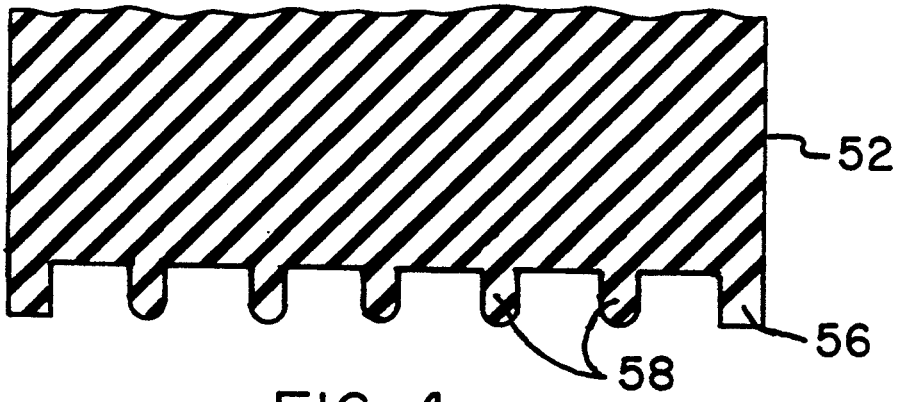
FIG. 4

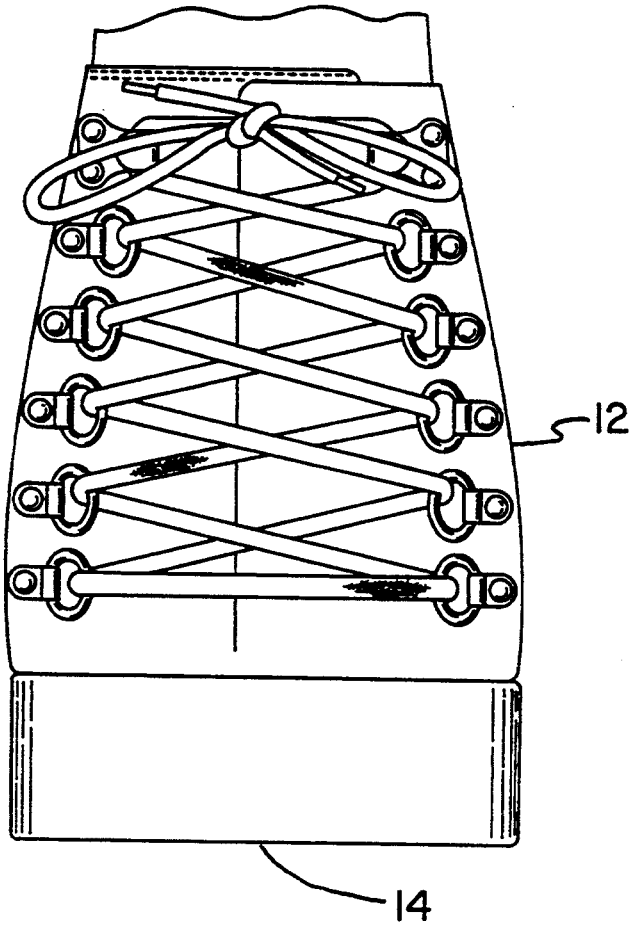
FIG. 5
FIG. 6
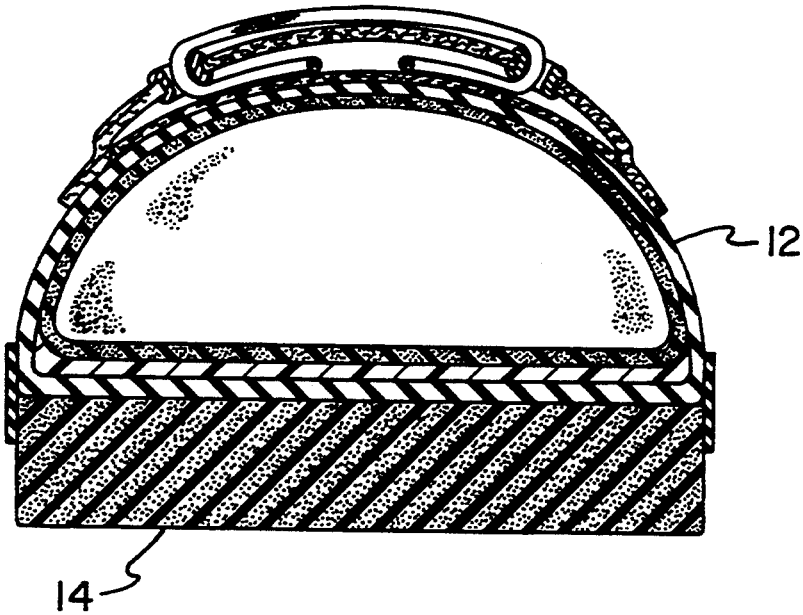

BOOTS FOR OUTDOOR USE BY SPORTS PERSONS

BACKGROUND OF THE INVENTION

1. Field of the Invention

The present invention relates to boots for outdoor use by sports persons and more particularly pertains to new and improved foot wear with increased insulation and support and noise abatement features.

2. Description of the Prior Art

The use of boots is known in the prior art. More specifically, boots heretofore devised and utilized for the purpose of use by sports persons are known to consist basically of familiar, expected, and obvious structural configurations, notwithstanding the myriad of designs encompassed by the crowded prior art which has been developed for the fulfillment of countless objectives and requirements.

The prior art discloses a large number of boots specifically designed for outdoor use. By way of example, U.S. Pat. Nos. 5,024,008 to Maples and 5,168,643 to Laurain disclose devices for outdoor use to abate sound through the use of insert components within the sole.

U.S. Pat. Nos. 3,061,951 to Barron and 4,893,421 to Folks disclose boots with supplemental components for use beneath the sole of the wearer, the Folks device including a peripheral component and the Barron device with longitudinal air spaces.

Lastly, U.S. Pat. Nos. 4,896,439 to Morgan and 5,101,579 to Terlizzi disclose ballet slipper type devices, the Morgan device being designed for use over a boot.

In this respect, the boots for outdoor use by sports persons according to the present invention substantially departs from the conventional concepts and designs of the prior art, and in doing so provides an apparatus primarily developed for the purpose of new and improved foot wear with increased insulation and support and noise abatement features.

Therefore, it can be appreciated that there exists a continuing need for new and improved boots for outdoor use by sports persons which can be used for new and improved foot wear with increased insulation and support and noise abatement features. In this regard, the present invention substantially fulfills this need.

SUMMARY OF THE INVENTION

In view of the foregoing disadvantages inherent in the known types of boots now present in the prior art, the present invention provides an improved boots for outdoor use by sports persons. As such, the general purpose of the present invention, which will be described subsequently in greater detail, is to provide new and improved boots for outdoor use by sports persons and method which has all the advantages of the prior art and none of the disadvantages.

To attain this, the present invention essentially comprises new and improved boots for outdoor use by sports persons and the like comprising, in combination, an upper formed of an instep section formed of a conformable leather material, a back ankle section formed of a conformable leather material, a lower forward peripheral section formed of a rubber material and with an opening along the upper front with a tongue within the opening, a plurality of eyelets formed along the upper front opening including apertures therebelow and metallic rings thereabove with lacings extending through the eyelets and rings above the tongue for enclosing the opening during use, a plurality of metallic rings extending in vertical lines adjacent the back ankle section from below the ankle to above the ankle with lacings extending through the rings for providing additional support to the rear a wearer's boot and lower leg, a sole having an intermediate layer as an extension of the upper with a layer of flexible material thereabove and a sponge rubber sole therebelow in the forward portion and a rubber heel therebelow in the rear portion, the rubber heel being formed with a peripheral ridge and linear projections extending forwardly and rearwardly thereof along the length of the heel, a soft conformable inner pad within the upper and sole for contact with the wearer's foot and stocking thereover with a layer of insolation material located in the rear region, a periphery of a padded construction at the upper extent of the upper, and a pull tab at the upper extent at the rear of the upper.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved boots for outdoor use by sports persons which have all the advantages of the prior art boots and none of the disadvantages.

It is another object of the present invention to provide new and improved boots for outdoor use by sports persons which may be easily and efficiently manufactured and marketed.

It is further object of the present invention to provide new and improved boots for outdoor use by sports persons which are of durable and reliable constructions.

An even further object of the present invention is to provide new and improved boots for outdoor use by sports persons which are susceptible of a low cost of manufacture with regard to both materials and labor, and which accordingly are then susceptible of low prices of sale to the consuming public, thereby making such boots for outdoor use by sports persons economically available to the buying public.

Still yet another object of the present invention is to provide new and improved boots for outdoor use by sports persons which provide in the apparatuses and methods of the prior art some of the advantages thereof, while simultaneously overcoming some of the disadvantages normally associated therewith.

Still another object of the present invention is to abate noise in boots while increasing insulation and support.

Lastly, it is an object of the present invention to provide new and improved boots for outdoor use by sports persons and the like comprising, in combination, an upper formed of an instep section, a back ankle section, a lower forward peripheral section and with an opening along the upper front with a tongue within the opening, a plurality of eyelets formed along the upper front opening with lacings extending through the eyelets above the tongue for enclosing the opening during use, a plurality of metallic rings extending in vertical lines adjacent the back ankle section from below the ankle to above the ankle with lacings extending through the rings for providing additional support to the rear a wearer's boot and lower leg; and a sole having an intermediate layer as an extension of the upper with a layer of flexible material thereabove and a sponge rubber sole therebelow in the forward portion and a rubber heel therebelow in the rear portion, the rubber heel being formed with a peripheral ridge and linear projections extending forwardly and rearwardly thereof along the length of the heel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a bottom view of the boot as shown in the prior Figures.

FIG. 4 is a sectional view of the boot taken along line 4—4 of FIG. 2.

FIG. 5 is a sectional view of the boot taken along line 5—5 of FIG. 2.

FIG. 6 is a sectional view of the boot taken along line 6—6 of FIG. 2.

The same reference numerals refer to the same parts through the various Figures.

DESCRIPTION OF THE PREFERRED EMBODIMENT

Figure 1:
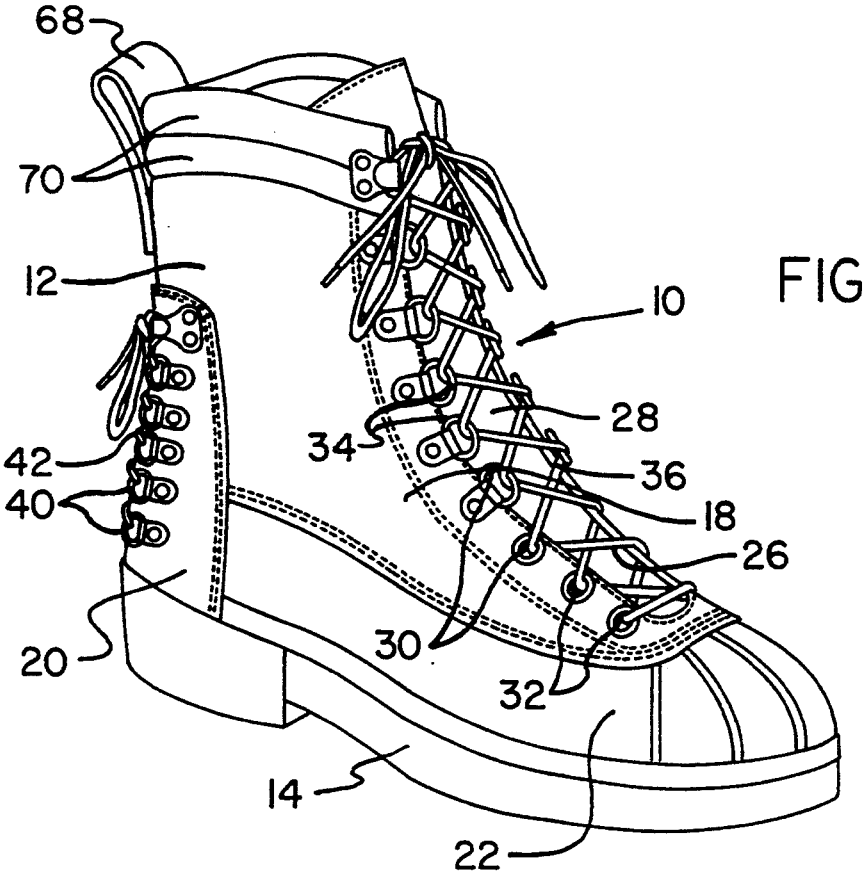
FIG. 1 is a perspective illustration of the preferred embodiment of the boots for outdoor use by sports persons constructed in accordance with the principles of the present invention.

With reference now to the drawings, and in particular to FIG. 1 thereof, the preferred embodiment of the new and improved boots for outdoor use by sports persons embodying the principles and concepts of the present invention and generally designated by the reference numeral 10 will be described.

More specifically, it will be noted in the various Figures that the new and improved boot 10 is for outdoor use by sports persons and the like. In its broadest terms the boot comprises an upper 12, and a sole 14 and other associated components for increased performance.

More specifically, the upper 12 is formed of an instep section 18. Such section is fabricated of a conformable leather material. A back ankle section 20 is also part of the upper 12. Such section is also fabricated of a conformable leather material. The third section of the upper is a lower front peripheral section 22. Such section is preferably fabricated of a rubber material. An opening 26 is formed along the upper front with a tongue 28 positioned within the opening.

A plurality of eyelets 30 are formed along the upper front opening. Such eyelets include apertures, or eyelets 32 therebelow and metallic rings 34 thereabove. Lacings 36 extending through the eyelets and rings above the tongue. The purpose of the lacings 36 is for enclosing the opening 26 during use.

A plurality of metallic rings 40 are also provided. Such rings 40 extending in vertical lines adjacent the back ankle section. They extend from below the ankle to above the ankle. Supplemental lacings 42 extend through the rings 40 for providing additional support to the rear a wearer's boot and lower leg. Note FIGS. 1 and 5.

Figure 2:
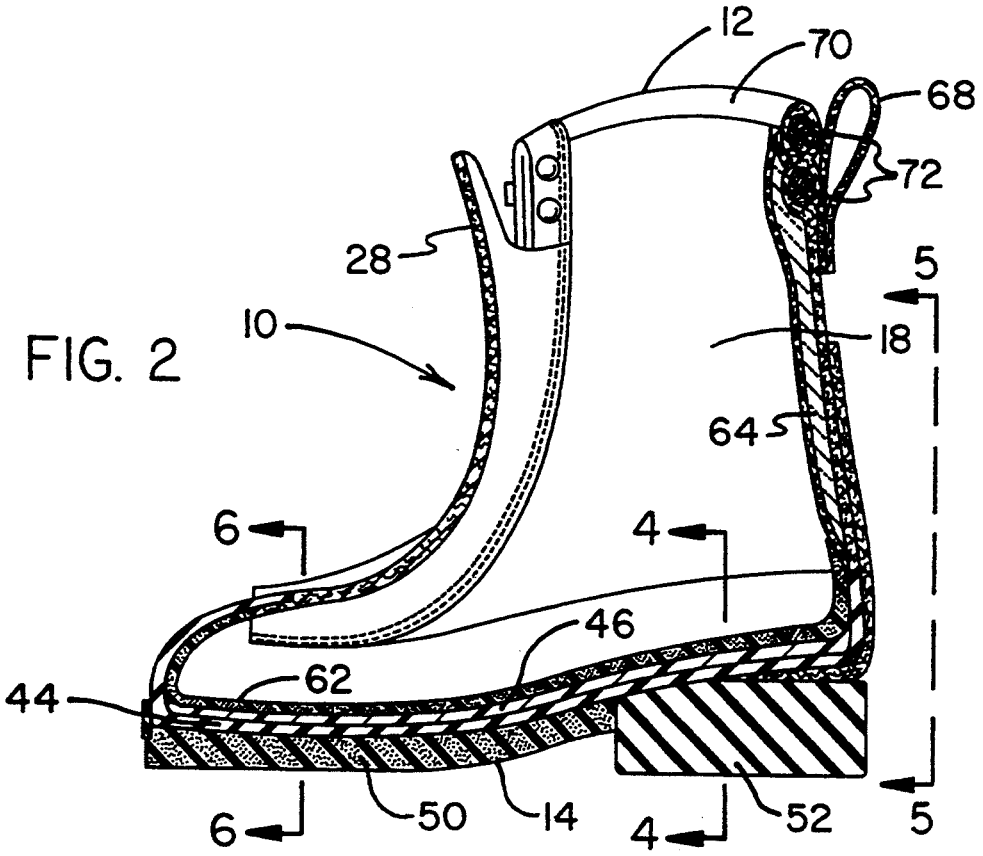
FIG. 2 is a sectional view of the boot of FIG. 1 taken vertically along the center thereof.

The second major component of the shoe is the sole 14. Note FIGS. 2 and 6. The sole has an intermediate layer 44 as an extension of the upper 12. The sole also has a layer of flexible material 46 thereabove. Exteriorly, the sole 12 also includes a sponge rubber sole 50 therebelow in the forward portion and a rubber heal 52 therebelow in the rear portion. The sponge rubber sole 50 adds a noise abatement feature since it will conform around twigs while walking to preclude the breaking noise. The rubber heal 52 is formed with a peripheral ridge 56 and linear recesses 58 extending forwardly and rearwardly thereof along the length of the heal. This arrangement provides a gripping capability which is particularly beneficial when climbing. Note FIGS. 3 and 4.

A soft conformable inner pad 62 is provided interiorly within the upper and sole. This is for insulation and is positioned for contact with the wearer's boot and stocking. In addition, a layer of insulation material 64 located interiorly in the rear region.

A pull tab 68 is provided at the upper end of the rear of the upper for helping the wearer put on the boot. A final feature for wearer comfort is the peripheral padding 70 formed as two tubes at the uppermost edge of the boot. These are formed of oval strips of an elastomeric material 72 secured within the material of the upper 12.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted falling within the scope of the invention.

What is claimed as being new and desired to be protected by Letters Patent of the United States is as follows:

1. A new and improved boot for outdoor use by sports persons comprising, in combination:

an upper formed of an instep section formed of a conformable leather material, a separate back ankle section formed of a conformable leather material, a separate lower forward peripheral section formed of a rubber material and with an opening along the upper front with a tongue within the opening, the back ankle section overlying a rearward portion of the instep section and the lower forward peripheral section;

a plurality of eyelets formed along the upper front opening including apertures therebelow and metallic rings thereabove with lacings extending through the eyelets and rings above the tongue for enclosing the opening during use;

a plurality of metallic rings extending in vertical lines adjacent the back ankle section along the length thereof with lacings extending through the rings for providing additional support there adjacent;

a sole having an intermediate layer as an extension of the upper with a layer of flexible material thereabove and a sponge rubber sole therebelow in the forward portion and a rubber heel therebelow in the rear portion, the rubber heel being formed with a peripheral ridge and linear projections extending forwardly and rearwardly thereof along the length of the heel;

a soft conformable inner pad within the upper and sole for contact with the wearer's foot and stocking thereover with a layer of insulation material located in the rear region;

a periphery of a padded construction at the upper extent of the upper; and a pull tab at the upper extent at the rear of the upper.

* * * * *